US011697894B2

(12) United States Patent
Kousalik et al.

(10) Patent No.: US 11,697,894 B2
(45) Date of Patent: Jul. 11, 2023

(54) METHOD OF CONTROLLING AN OPTICAL ELEMENT AT A WORKSTATION OF A TEXTILE MACHINE, ESPECIALLY A YARN MANUFACTURING MACHINE, AND A TEXTILE MACHINE

(71) Applicant: Rieter CZ s.r.o., Usti nad Orlici (CZ)

(72) Inventors: Pavel Kousalik, Usti nad Orlici (CZ); Miroslav Stusak, Chocen (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 296 days.

(21) Appl. No.: 16/971,816

(22) PCT Filed: Feb. 22, 2019

(86) PCT No.: PCT/CZ2019/050007
§ 371 (c)(1),
(2) Date: Aug. 21, 2020

(87) PCT Pub. No.: WO2019/161816
PCT Pub. Date: Aug. 29, 2019

(65) Prior Publication Data

US 2020/0385894 A1 Dec. 10, 2020

(30) Foreign Application Priority Data

Feb. 22, 2018 (CZ) ..... CZ2018-88

(51) Int. Cl.
*D01H 13/14* (2006.01)
*B65H 63/00* (2006.01)

(52) U.S. Cl.
CPC ..... *D01H 13/14* (2013.01); *B65H 63/00* (2013.01); *B65H 2701/31* (2013.01)

(58) Field of Classification Search
CPC ..... D01H 13/14; D01H 13/16; D01H 13/165; D01H 13/1666; D01H 13/26; D01H 13/32;
(Continued)

(56) References Cited

U.S. PATENT DOCUMENTS 3,648,027 A * 3/1972 Ganong, Jr. ..... B65H 63/00 377/16
4,300,342 A * 11/1981 Highsmith, Jr. ..... D01H 13/165 57/81
4,319,235 A * 3/1982 Janousek ..... D01H 13/165 19/0.21

FOREIGN PATENT DOCUMENTS

CN 1074255 A 7/1993
CN 1688756 A 10/2005
(Continued)

OTHER PUBLICATIONS

PCT Search Report, dated Aug. 31, 2020.
(Continued)

*Primary Examiner* — Shaun R Hurley
*Assistant Examiner* — Patrick J. Lynch
(74) *Attorney, Agent, or Firm* — Dority & Manning, P.A.

(57) ABSTRACT

A method controls a device configured on a textile machine, wherein the device is one or both of (1) a sensor of physical quantities having a primary function in a primary operating mode to detect a state at a workstation of the textile machine; or (2) an optical signaling device having a primary function in a primary operating mode to provide visual information about a state of a workstation, group of workstations, or the textile machine. The method includes targeted switching of the device to a secondary operating mode wherein the device performs a secondary function that is different from the
(Continued)

primary function. After performance of the secondary function, the device is switched back to the primary operating mode.

12 Claims, 3 Drawing Sheets

(58) Field of Classification Search
CPC .... D01H 13/1616; B65H 63/00; B65H 63/02; B65H 63/024; B65H 63/028; B65H 63/0324
See application file for complete search history.

(56) References Cited

FOREIGN PATENT DOCUMENTS

| | | | |
|---|---|---|---|
| CN | 2895466 | Y | 5/2007 |
| CN | 202 450 215 | U | 9/2012 |
| CN | 202 925 215 | U | 5/2013 |
| CN | 206033962 | U | 3/2017 |
| CN | 106835398 | A | 6/2017 |
| CZ | 281809 | B6 | 2/1994 |
| CZ | 292980 | B6 | 1/2004 |
| CZ | 20040368 | A3 | 11/2005 |
| CZ | 299647 | B6 | 1/2008 |
| DE | 101 63 849 | A1 | 7/2002 |
| DE | 10 2014 211249 | A1 | 12/2014 |
| EP | 2 272 782 | A2 | 1/2011 |
| WO | WO 2010/095023 | A1 | 8/2010 |
| WO | WO 2014/012189 | A1 | 1/2014 |

OTHER PUBLICATIONS

PCT IPRP. Aug. 27, 2020.
CZ Search Report, dated Dec. 17, 2018.
Chinese Office Action with Translation, dated Jan. 6, 2022.

* cited by examiner

METHOD OF CONTROLLING AN OPTICAL ELEMENT AT A WORKSTATION OF A TEXTILE MACHINE, ESPECIALLY A YARN MANUFACTURING MACHINE, AND A TEXTILE MACHINE

TECHNICAL FIELD

The invention relates to a method of controlling a sensor of physical quantities and/or an optical signalling means on a textile machine, especially a yarn manufacturing machine, on which the sensor of physical quantities is primarily intended to detect the state at a workstation and the optical signalling means is primarily intended to provide visual information about the state of a workstation, a group of workstations, or the machine.

In addition, the invention relates to a textile machine, especially a yarn manufacturing machine, having at least one row of workstations comprising at least one sensor of physical quantities and/or one optical signalling means, whereby the sensor of physical quantities is primarily intended to detect the state at a workstation and the optical signalling means is primarily intended to provide visual information about the state of a workstation, group of workstations, or machine and the sensor of physical quantities and/or the optical signalling means are connected to a control and evaluation device.

BACKGROUND ART

Textile machines comprise not only actuators, but also a number of sensors and signalling elements, especially optical elements and sensors. The optical sensors include, in particular, sensors of quality and/or the presence of yarn, as well as sensors of the state of yarn, e.g., sensors of the movement of a traveller a ring spinning machine, etc. The signalling elements are optical signalling means, most recently especially LEDs, which make it possible for the machine to provide visual information to the machine surroundings about the state of the machine, the state of a workstation, the state of a group of workstations, etc. For example, on ring spinning machines, optical sensors of the movement of a traveller on a workstation are normally installed, which monitor a light field whose optical properties are influenced by the passage of the traveller through a particular point or area on the ring, whereby from the time sequence of each light field change that is caused by the passage of the traveller through the field being monitored, it is possible to determine the movement parameters of the traveller on the ring, especially the rotation speed of the traveller and the states of the workstation related to this, such as whether the workstation is producing yarn, whether the revolutions at the workstation are correct, whether a yarn break has occurred, etc. Any yarn breakage or incorrect speed are signalled by an optical LED to the operator of the machine or to the service robot to ensure that appropriate measures are taken to remove the malfunction. This optical signalling means is most commonly located at each spinning unit and/or is designed as an optical signalling means common to a group of spinning units, a machine section, etc.

On the current machines, in the course of the machine operation or during the operation of a workstation of the machine, there are operating modes, functional modes, or status in which it is desirable or necessary to transmit information and/or data about the operator activity to/from the workstation/machine. For these specific interactions, the state of the art uses an additional special communication device, located at the respective workstation, group of workstations, or machine, e.g. a button, another sensor, magnetic field receiver, etc., which provides the operator-machine interaction. As a result, the machine comprises a plurality of special sensors and signalling elements intended to perform the set task or operation, which is a drawback in terms of complexity, space requirements, etc. Moreover, it is disadvantageous because when a function needs to be added, it is necessary to supplement the workstation with an additional sensor or additional signalling device or additional communication device, etc.

An aim of the invention is to allow extending the sensing and/or communication and/or visualization capabilities of a workstation or a machine, without having to physically add a sensor and/or communication means and/or signalling means, in other words, to improve the existing sensing and/or communication and/or signalling means on a textile machine.

Principle of the Invention

Objects and advantages of the invention will be set forth in part in the following description, or may be obvious from the description, or may be learned through practice of the invention.

The aim of the invention is achieved by a method of controlling a sensor and/or optical signalling means at a workstation of a textile machine, especially a yarn manufacturing machine, in which the sensor of physical quantities and/or the optical signalling means deliberately switches to the secondary operating mode other then the primary operating mode and after performing the secondary function in the secondary operating mode, the sensor of physical quantities and/or the optical signalling means targetedly switches back to the primary operating mode.

In addition, the invention relates to several methods of controlling an optical element in which the operation of the optical element is controlled in different relationships with the operation of the workstation or to the conditions at the workstation.

The principle of the textile machine for implementing the present invention consists in that a control and evaluation device comprises means for targetedly switching the sensor of physical quantities and/or the optical signalling means to the secondary operating mode, in which the sensor of physical quantities and/or the optical signalling means is used in the same place for at least one purpose other than its primary purpose.

The invention allows a secondary use of the sensor of physical quantities and/or the optical signalling means, e.g., the optical sensor and/or the optical signalling means which are primarily intended to detect the state of a workstation and/or to provide visual information about the state of that workstation, wherein the secondary use of the sensor of physical quantities and/or the optical signalling means for a purpose or purposes other than the primary purpose or primary purposes of the sensor of physical quantities and/or the optical signalling means. This is usable with advantage especially on a ring spinning machine in which generally there is very little space for one workstation and therefore adding other sensors, signalling elements or communication devices is more difficult in this case than in other types of textile machines. Thus, by using the present invention, there is no need to install other (additional) sensors and/or communication devices at a workstation or group of workstations, e.g., for the purpose of transmitting information on operator activity at the workstation, because by using the present invention, already installed sensors and/or signalling means (e.g., LEDs) are switched to another (secondary) functional mode of operation in a controlled manner, and in this other functional mode of operation, these existing means fulfill a function other than their primary function for which they are or have been installed on the machine. For example, in optical sensors, their primary function is to monitor the yarn or monitor the traveller on the ring, in the case of signalling means (information LEDs), their primary function is to emit light, if appropriate, correspondingly colored light, to visually inform the operator or service robot about the state of the workstation, etc.

DESCRIPTION OF DRAWINGS

The invention is schematically represented in a drawing, wherein.

EXAMPLES OF EMBODIMENT

Figure 1A:
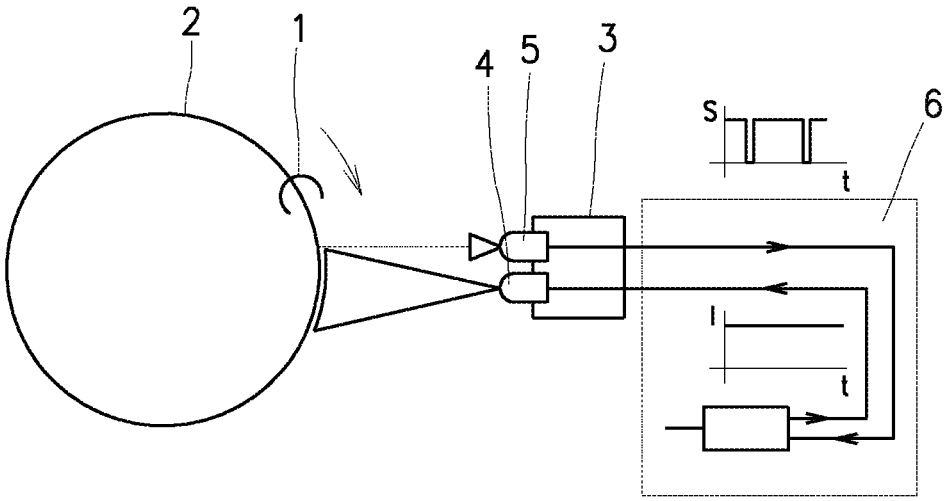
FIG. 1*a* and FIG. 1*b* show the use of the invention in the case of an optical sensor which is primarily intended to monitor the traveller movement on a ring at a workstation of a ring spinning machine.
Figure 1B:
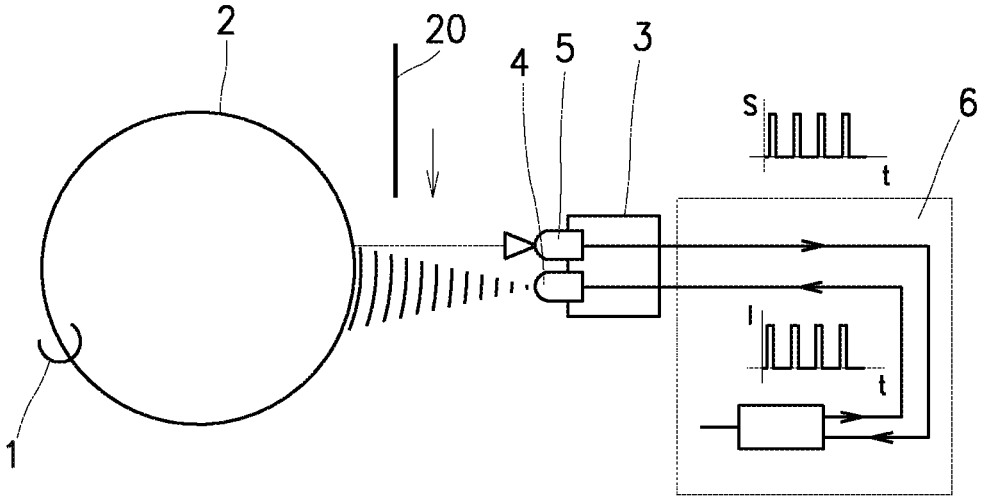
Figure 2A:
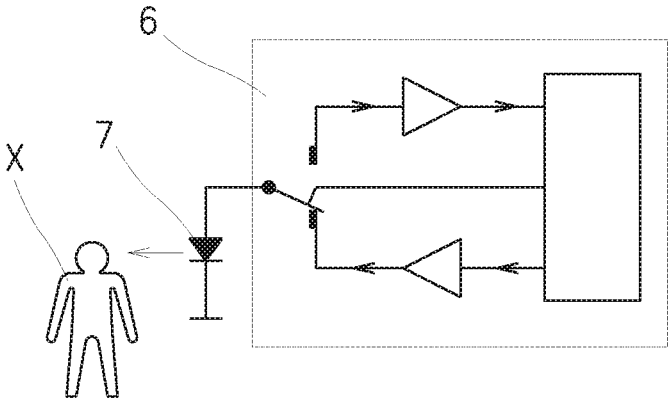
FIG. 2*a* and FIG. 2*b* illustrate the use of the invention in an LED signalling means primarily intended to visually inform the operator and/or the service robot about the state of the workstation.
Figure 2B:
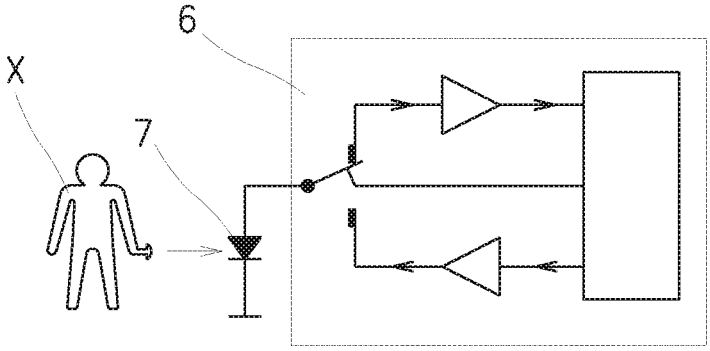

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The invention will be described with reference to exemplary embodiments on a textile machine, in particular on a ring spinning machine, namely with reference to the secondary use of an optical sensor primarily intended to monitor the movement of a traveller on a ring at a workstation of a ring spinning machine, as well as the secondary use of an LED signalling means primarily intended to visually inform the operator and/or a service robot about the state of the workstation.

A ring spinning machine comprises a row of workstations arranged next to each other. Each workstation comprises a rotatable drive spindle with a tube placed on it. On the tube a yarn package is formed in a known manner during spinning, thus forming a cop, i.e. a tube with a package. The spindle is rotatably driven. A balloon limiter, a yarn guide, and a roving drafting device are arranged above the bobbin. From the roving, yarn is formed by drafting and twisting and subsequently it is wound on the tube into the bobbin. A common ring bench is assigned to a row of workstations. Attached to a ring bench by means of a holder is a ring 2 on whose crown a traveller 1 is movably mounted. The rotatable spindle of each workstation passes through the centre of the ring 2. During spinning, the traveller 1 runs around the crown of the ring 2 around the cop, since it is driven by the yarn which is wound on the tube due to the rotation of the cop.

The ring 2 is associated with an optical sensor 3 of the traveller 1 movement, which comprises a radiation source 4 and a reflected light receiver 5. The optical sensor 3 detects changes in the light field caused by the passage of the traveller 1 through the respective ring 2 zone, which is irradiated by the radiation source 4, which is the primary function of the optical sensor 3 in view of the present invention. To fulfill this primary function, the sensor 3 of the traveller 1 is connected to a control and evaluation device 6, which controls the radiation source 4 and processes a signal from the reflected light receiver 5. According to the present invention, the control and evaluation device 6 is provided with means for switching the sensor 3 to the secondary mode of operation in which the radiation source 4 generates time-modulated radiation which simulates the traveller 1 movement on the ring 2, i.e., which, after being picked up by the sensor 3 and evaluated by the control and evaluation device 6, manifests itself as the movement of the traveller 1 on the ring 2, without the traveller 1 actually moving on the ring. Furthermore, to improve the differentiation of the primary and secondary modes of operation of the optical sensor 3, it is desirable if the parameters of this simulated movement of the traveller 1 on the ring 2 differ from the actual or expected parameters of the traveller 1 during yarn production, for example, the frequency of the simulated passage of the traveller 1 through the monitored ring 2 zone differs from the frequency of the actual or expected passage of the traveller 1 through the monitored ring 2 zone during yarn production. Ideally, this parameter differentiation is carried out in such a way that the control device 6 controls the radiation source 4 such that the radiation generated by the radiation source 4 has the desired parameters, which means that the control and evaluation device 6 is provided with means for controlling the radiation source 4 both in the primary and the secondary operating modes of the sensor 3 of the traveller 1 movement. In that case, the system (or, more specifically, the control and evaluation device 6) knows or finds out that the relevant sensor 3 is switched to the secondary operating mode and the control and evaluation device 6 activates means for evaluating this secondary mode. It follows from this that the control and evaluation device 6 is provided with means for controlling and evaluating the secondary operating mode of the sensor 3. For operational reasons, it is advantageous if this is done at a time when the workstation is not spinning, i.e., is not producing yarn, or at a time when the signal from the sensor of the traveller movement is not evaluated as, or is not considered to be, the actual movement of the traveller 1 on the ring 2. If, in this described secondary mode of operation of sensor 3 of the traveller 1 movement, the sensor 3 is shaded, for example, by intentionally inserting a non-reflecting element into the radiation path leading from the radiation source 4 to the reflected light receiver 5, the detection of the simulated movement of the traveller 1 on the ring 2 is interrupted, which is detected by the control and evaluation device 6 as an interruption of the simulated traveller 1 movement. Detection of this state, i.e. detection of the interruption of the simulated movement of the traveller 1 can be utilized in various situations that may occur during the machine operations.

One possibility of using the secondary operating status of the sensor 3 of the traveller 1 movement at a workstation of a ring spinning machine is to confirm operator intervention at a specific workstation, during which the sensor 3 of the traveller 1 movement and its radiation source 4 are intentionally switched to the above-mentioned secondary operating status and as soon as the operator completes the service operation at the given workstation, the operator simply shades the sensor 3 of the traveller 1 movement at this workstation, e.g., by briefly inserting a shade 20 between the sensor 3 of the traveller 1 movement and the ring 2, which is detected by the control and evaluation device 6 configured according to the present invention and recognized as information that the intervention at the specific workstation has been terminated and it is possible to start the next steps of the operation of the given workstation, etc. Therefore, it is not necessary for the operator, e.g., to activate the confirmation button, etc.

In some applications, it is preferable not to switch the sensor 3 to the secondary mode during the whole time when the primary function of the sensor is not required, e.g. at yarn breakage, but it is preferable to change the primary and secondary modes where appropriate so that the secondary function of the sensor 3 is fully maintained and the primary function is maintained fully or only partially. In this case, the control and evaluation device 6 is able to recognize a fully active secondary function of the sensor 3 (e.g., to detect the deliberate shading of the sensor 3 by the operator after the intervention is terminated) as well as an active primary function of the sensor 3 (e.g., from the light reflected from the ring, it is able to recognize spinning-in at a specific workstation and the subsequent regular movement of the traveller 1 on the ring 2 during the resumed stable spinning). After this detection of the active primary function, it is usually no longer necessary to switch the sensor 3 to the secondary mode and the sensor remains in the primary mode of its operation.

Another example of using the secondary operating status of the traveller movement sensor 3 at a workstation of a ring spinning machine is addressing individual workstations to the machine control system. Ring spinning machines that have 1000 or more workstations arranged next to each other are not uncommon. For the proper operation of such a machine it is necessary for each workstation to be properly addressed to the control system. So far, this has been done manually and has been a lengthy and laborious process. By utilizing the present invention, this process is greatly accelerated and simplified so that on the machine, for example, when it is first started, the sensors 3 of the traveller movement at the individual workstations are switched to the above-described secondary mode of operation, i.e. a mode in which the radiation sources 4 at each workstation simulate the passages of the traveller 1 by varying the luminous flux, and these simulated passages of the traveller 1 are detected at each workstation by the respective control and evaluation device 6. Then, it is sufficient when the operator gradually, for example, by a paper or plastic or other suitable card or another suitable shading means 20, shades the sensors 3 of the traveller movement successively at the individual workstations of the whole row of workstations as the individual workstations go in succession, and the control and evaluation system 6 recognizes (identifies) the individual workstations, and, accordingly, the machine system assigns each particular sensor 3 to the individual workstations without the need to manually enter the number of the workstation. Following such addressing, the system of monitoring the traveller 1 at the workstations switches back to the primary operating mode in which the actual movement of the traveller 1 on the ring 2 is monitored at the respective workstations.

Another example of using a sensor of physical quantities in the form of an optical sensor 3 operating in the secondary mode would be, e.g., using an optical sensor of the presence of yarn at a workstation of a rotor or air jet spinning machine, wherein the sensor 3 is switched to the secondary operating status at the workstation of the rotor or jet spinning machine, whereby the operator or the service robot shades the sensor 3 after performing a service operation, which is detected by the control system as confirmation of the operator intervention at a particular workstation. The optical sensor 3, with its radiation source 4 and the radiation receiver 5, here acts as a sensor of physical quantities.

The invention can also be adequately applied to other elements of the workstation or group of workstations or machine that are capable of switching to the secondary mode of operation. Typical elements which allow this are the signalling means LEDs 7 which, in their primary mode of operation (functional mode), emit light, visually perceptible signals, as information about the state of the workstation, group of workstations or machine, etc. According to the present invention, the LED 7, which is primarily intended to emit radiation, is targetedly switched to the secondary operating mode, in which it is able to detect ambient radiation. As a rule, it is the detection of radiation wavelengths comparable to the wavelengths of radiation that the respective LED 7 is capable of emitting. Switching the LED 7 to the secondary mode is performed as needed, but especially at times when it is necessary to transmit information and/or operator activity data at the workstation, group of workstations, machine, etc. The LED 7 is connected to the control and evaluation device 6, which controls intentional switching of the respective LED 7 between the primary mode of operation, i.e. the radiation emission, and the secondary mode of operation, i.e. the incident (ambient) radiation detection by controlling the inputs and outputs of the respective LED 7. Thus, in the normal primary mode, the LED 7 emits radiation and provides signals to the operator or the service robot about the state, e.g. the need for intervention at the workstation, whereas in the secondary mode, the LED 7 receives ambient radiation or its changes and the control and evaluation device 6 is able to recognize the amount of radiation received by this LED 7 in the secondary operating mode. This can be used, for example, to transmit signals to the control and evaluation device 6 in different ways, e.g., including the simple shading of the respective LED 7 by the operator upon termination of the operation of a particular workstation or, on the contrary, additional illumination of the LED 7 by the operator X, the transmission of more complex information, e.g. created (or encoded) various series of illumination and shading of the respective visually signalling LED 7 switched to the secondary mode of reception of ambient radiation, up to the transmission of more complex information by means of light signals of suitably modulated radiation of a suitable frequency which can be afterwards transmitted to the control and evaluation device 6 via the primarily visually signalling LED 7 switched to the secondary mode of the radiation receiver. By this signal coding in the secondary mode of operation of the respective LED 7, it is also possible to precisely identify the origin of transmitter of such a code, thereby increasing security.

Another example of using the visually signalling LED 7 in the secondary mode of the radiation receiver is, for example, using the visually signalling LED 7 at a workstation of a rotor or air jet spinning machine for a similar purpose as is described in the preceding paragraph. Visually signalling LED 7 here fulfills the function of an optical signalling means.

Textile machines generally comprise a number of other sensing elements which are intended to perform the primary function of detecting or providing visual information and which can be according to the present invention targetedly switched to the secondary operating mode, in which these primarily sensing or primarily signalling means are used for the secondary purposes for which they were not originally intended, and for which it is currently necessary to use proprietary solutions, means or procedures on the machine, whereby the primary function of detection or visual information is inactive in the secondary operating mode.

Figure 3A:
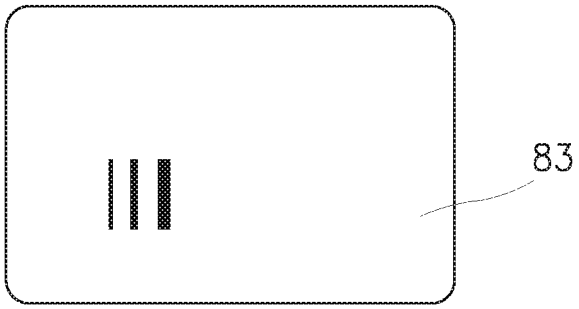
FIG. 3*a* shows an exemplary embodiment of a translucent coding shading means.
Figure 3B:
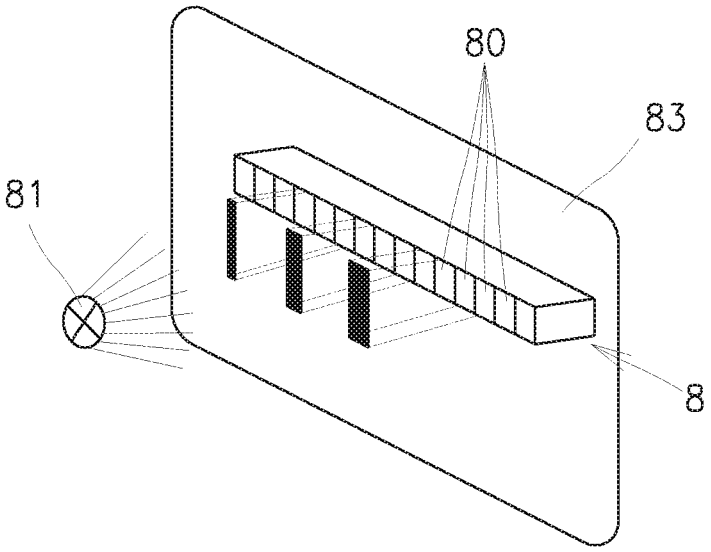
FIG. 3*b* a schematic 3D representation of the use of the invention with a yarn sensor and a coding shading means.
Figure 3C:
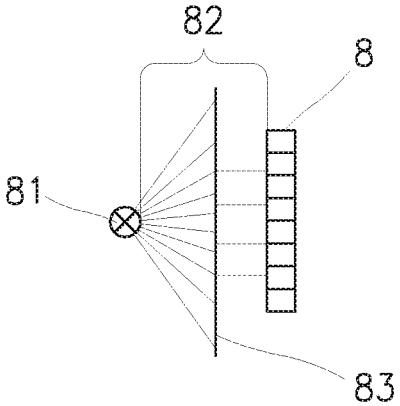
FIG. 3*c* is a plan view of the embodiment of FIG. 3*b*.

One of such other sensing elements usable according to the present invention is an optical sensor of yarn comprising at least one row 8 of radiation sensitive elements 80 arranged next to each other, e.g. a CCD sensor or CMOS sensor, etc. An example is shown in FIGS. 3*a*, 3*b* and 3*c*. A radiation source 81, e.g., a LED, is located as standard against the row 8 of radiation sensitive elements 80. Between the radiation source 81 and the row 8 of radiation sensitive elements 80 there is a gap 82 for the passage of unillustrated yarn. The radiation sensitive elements 80 are coupled to an evaluation device of their irradiation. The primary operating mode of this type of sensor is monitoring and evaluating yarn, e.g. evaluating the presence or quality of yarn, etc. Using this yarn sensor for the present invention consists in that the sensor switches to the secondary mode in which there is no yarn in the gap between the radiation source 81 and the row 8 of radiation sensitive elements 80. The radiation source 81 emits radiation of the same or lower or higher intensity than in the primary operating mode directly to the row 8 of radiation sensitive elements 80. As soon as the operator completes the work at the respective workstation, he or she simply inserts a suitable shading means 83 into the gap between the radiation source 81 and the row 8 of radiation sensitive elements 80. This is detected by the evaluation device as the shading of all or some of the radiation sensitive elements 80 and is considered a signal from the operator confirming termination of the work at the workstation. So as to improve the security of this signalling, e.g., to avoid mistake by accidentally shading the row 8 of radiation sensitive elements 80, or so as to identify a particular person or operator, the shading means 83 is formed by a translucent material, e.g., a plastic card on which a shading pattern is formed, e.g., in the form of a bar code etc., by which, after inserting the shading means 83, a plurality of radiation sensitive elements 80 are shaded at certain relative positions in the row 8 and the evaluation device is provided with means for identifying this code, identifying the operator, etc., so that it is able to recognize not only the fact of the shading being made, but also to identify the source of that shading.

Modifications and variations can be made to the embodiments illustrated or described herein without departing from the scope and spirit of the invention as set forth in the appended claims.

The invention claimed is:

1. A method of controlling an optical sensor device configured on a textile machine, the optical sensor configurable between a primary operating mode that transmits and receives a first form of reflected radiation that senses a state of a physical quantity related to ongoing production of a textile product at a workstation of the textile machine and a secondary operating mode that receives a second form of reflected radiation that provides information regarding service operations at the work station from a change in an operating state of the textile machine, the method comprising:

targeted switching of the optical sensor to the secondary operating mode when the service operations are required and detection of the physical quantity at the workstation is not required; and evaluation of the second form of radiation with a control and evaluation device for subsequent targeted switching of the optical sensor back to the primary operating mode when the detection of the physical quantity of the product at the workstation is required.

2. The method according to claim 1, wherein the textile machine is a rotor or air jet spinning machine and the optical sensor is switched to the secondary operating mode at workstations having a service operation being performed thereon, wherein after performance of the service operation an operator or service robot interacts with the optical sensor in a manner that is detected by the control and evaluation device as confirmation of performance of the service operation.

3. A method of controlling an optical sensor device configured on a textile machine, the optical sensor configurable between a primary operating mode that detects a state of a physical quantity related to ongoing production of a textile product at a workstation of the textile machine and a secondary operating mode that provides visual information about a change in an operating state of the workstation, a group of the workstations, or the textile machine, the method comprising:

targeted switching of the optical sensor to the secondary operating mode at the change in the operating state wherein detection of the physical quantity at the workstation is not required;

subsequent targeted switching of the optical sensor back to the primary operating mode when the operating state changes again and detection of the physical quantity of the product at the workstation is required; and wherein the textile machine is a ring spinning machine and in the primary operating mode, the optical sensor detects speed of movement of a traveller on a ring by detecting changes in reflected radiation received by an optical receiver of the optical sensor caused by passage of the traveller through a radiation field zone emitted by a radiation source of the optical sensor, whereby in the secondary operating mode of the sensor, the radiation source generates time-modulated radiation that simulates movement of the traveller on the ring and is detected by the optical receiver and evaluated by a control and evaluation device.

4. The method according to claim 3, wherein the radiation source is controlled such that the simulated movement of the traveller on the ring has different parameters evaluated by the control and evaluation device as compared to actual or expected movement of the traveller on the ring.

5. The method according to claim 3, wherein the optical sensor is switched to the secondary operating mode during a service operation at a workstation of the ring spinning machine, whereby after finishing the service operation, an operator or a service robot shades the optical sensor, which is evaluated as confirmation of performance of the service operation at the workstation.

6. A method of controlling an optical signaling device configured on a textile machine, the optical signaling device configurable between a primary operating mode having a first function to transmit radiation indicating an operating state of the textile machine or one or more workstations of the textile machine, and a secondary operating mode having a second function to receive radiation indicating activity at the textile machine or one or more of the workstations, the method comprising:

targeted switching of the optical signaling device to the secondary operating mode when the operating state changes such that intervention activity is required at the textile machine or one or more of the workstations;

subsequent targeted switching of the optical signaling device back to the primary operating mode when the operating state changes again; and wherein the optical signaling device includes an LED that is switched from a radiation transmitter mode in the primary operating mode to a radiation sensor mode in the secondary operating mode, wherein an amount of radiation falling on the LED transmits data about the activity at the textile machine or one or more of the workstations that is monitored and evaluated in the secondary operating mode.

7. The method according to claim 6, wherein a shading or irradiation of the LED in the secondary operating mode is monitored for transmitted signals.

8. A method of controlling an optical sensor device configured on a textile machine, the optical sensor configurable between a primary operating mode that detects a state of a physical quantity related to ongoing production of a textile product at a workstation of the textile machine and a secondary operating mode that provides visual information about a change in an operating state of the workstation, a group of the workstations, or the textile machine, the method comprising:

targeted switching of the optical sensor to the secondary operating mode at the change in the operating state wherein detection of the physical quantity at the workstation is not required;

subsequent targeted switching of the optical sensor back to the primary operating mode when the operating state changes again and detection of the physical quantity of the product at the workstation is required; and wherein in the primary operation mode, the optical sensor detects a presence or quality of a produced yarn passing through a gap between a radiation source of the optical sensor and at least one row of radiation sensitive elements of the optical sensor, wherein the secondary mode of operation includes intentional shading and monitoring of at least some of the radiation sensitive elements by intentional insertion of a shading device into the gap.

9. The method according to claim 8, wherein the shading device produces a shading pattern from a defined number and distribution of the radiation sensitive elements being shaded, the shading pattern identifying an operator who inserts the shading device in the gap.

10. A method of controlling an optical sensor device configured on a textile machine, the optical sensor configurable between a primary operating mode that detects a state of a physical quantity related to ongoing production of a textile product at a workstation of the textile machine and a secondary operating mode that provides visual information about a change in an operating state of the workstation, a group of the workstations, or the textile machine, the method comprising:

targeted switching of the optical sensor to the secondary operating mode at the change in the operating state wherein detection of the physical quantity at the workstation is not required;

subsequent targeted switching of the optical sensor back to the primary operating mode when the operating state changes again and detection of the physical quantity of the product at the workstation is required; and wherein the textile machine includes a row the workstations with a respective optical sensor configured at each of the workstations in the row, all of the optical sensors in the whole row switched to the secondary operating mode and a state of the optical sensors are monitored at individual successive workstations of the row and individual changes in the sensors are sequentially assigned to the successive workstations in a machine control system.

11. A method of controlling an optical signaling device configured on a textile machine, the optical signaling device configurable between a primary operating mode having a first function to transmit radiation indicating an operating state of the textile machine or one or more workstations of the textile machine, and a secondary operating mode having a second function to receive radiation that is evaluated by a control and evaluation device indicating intervention activity at the textile machine or one or more of the workstations, the method comprising:

targeted switching of the optical signaling device to the secondary operating mode when the operating state changes such that the intervention activity is required at the textile machine or one or more of the workstations; and subsequent targeted switching of the optical signaling device back to the primary operating mode when the operating state changes again.

12. A textile machine, comprising:

a row of workstations; and one or both of:

(1) an optical sensor configurable between a primary operating mode to transmit and receive a first form of reflected radiation that senses a state of a physical quantity related to ongoing production of a textile product at a workstation of the textile machine, and a secondary operating mode to receive a second form of reflected radiation that is evaluated by a control and evaluation device to provide information regarding service operations at the workstation due to a change in an operating state of the textile machine or the workstation;

and (2) an optical signaling device configurable between a primary operating mode to transmit radiation indicating the operating state of the textile machine or the workstation, and a secondary operating mode to receive radiation that is evaluated by a control and evaluation device to indicate intervention activity at the textile machine or the workstation due to a change in the operating state.

* * * * *